US007000559B2

(12) United States Patent
Mah et al.

(10) Patent No.: US 7,000,559 B2
(45) Date of Patent: Feb. 21, 2006

(54) MODULARIZED UNDERWATER MOTIVE DEVICE

(75) Inventors: Pat Y. Mah, Hong Kong (CN); Alexander Joseph Kalogroulis, Coulsdon (GB)

(73) Assignee: Daka Research Inc. (Br. Virg. Isl Corp.) OffshoreIncorporations Centre, Tortolla (VG)

( * ) Notice: Subject to any disclaimer, the term of this patent is extended or adjusted under 35 U.S.C. 154(b) by 0 days.

(21) Appl. No.: 10/857,326

(22) Filed: May 28, 2004

(65) Prior Publication Data

US 2005/0279271 A1 Dec. 22, 2005

(51) Int. Cl.
*B63C 11/46* (2006.01)

(52) U.S. Cl. ..... 114/315; 440/6

(58) Field of Classification Search ..... 114/315; 440/6

See application file for complete search history.

(56) References Cited

U.S. PATENT DOCUMENTS 3,685,480 A * 8/1972 Peroni ..... 114/315
4,864,959 A * 9/1989 Takamizawa et al. ..... 114/315
6,848,385 B1 * 2/2005 Mah ..... 114/315

* cited by examiner

*Primary Examiner*—Sherman Basinger
(74) *Attorney, Agent, or Firm*—Curtis L. Harrington

(57) ABSTRACT

An underwater motive device provides an integrated and modular battery and motive housing which is carried within an outer housing and secured by a nose cone system. The nose cone system works against an "o" ring seal carried between a structure of the integrated and modular battery and motive housing and the outer housing. A pair of latches act as levers to forcibly push the nose cone in place to seal off the battery compartment, and with cam action when used to urge the nose cone to a disengaged position with respect to the "o" ring seal. Nose cone removal and re-sealing procedure can be accomplished easily, even by those of limited strength.

11 Claims, 4 Drawing Sheets

23
59
93
97
45
51
35
39
53
81
29
37
65
31
63
91
31
27
27
41
21
55
99
69
79
71
75
77
73
83
87
67
89
85
33
25
61

MODULARIZED UNDERWATER MOTIVE DEVICE

FIELD OF THE INVENTION

The present invention relates to improvements in the technology relating to in water and underwater mechanical motive structures and particularly to improvements relating to an underwater device which is simplified, has a core and motive section which is modularized, and has an improved access structure which stably enables access.

BACKGROUND OF THE INVENTION

Powered underwater motive devices have been known since the 1950's. Most of those earlier devices were metal and were built like small submarines. Access was had through hatches which had to be securely bolted or clamped in order to resist taking on water at depth. Water is harmful to both motors and batteries and must be sealed out. As a result, the underwater motive devices were large, bulky and designed with a mind to limit outside access to limit the sealing areas provided for service access.

Recent improvements in underwater motive devices have related to the safety of operation, including a slight delay in starting to prevent inadvertent operation. In addition, sealed chambers have been introduced to keep water out of the battery and motor compartments.

However, for small motive devices, providing an integral housing complete with sealing of the battery and motor compartment has proved difficult for users to easily access the battery and motor compartment. The only alternative to a strong seal was unacceptable as a weaker seal would cause the taking of the device to depth to result in cyclical pressure leakage. Where the device is used in salt water, even the slightest leakage can be disastrous.

Seals achieve their integrity by resilient sealing force and area. Both force and area contribute to the necessity for high force of replacement and removal. In a prior underwater motive device, air pressure and a pump were utilized to provide internal assist pressure to unseal the battery and motive compartments. Battery exchange required some setup and interconnectivity time.

Design of underwater motive devices generally allow sealing to be accomplished most effectively during manufacturing and for manufactured components which will not thereafter be disturbed. Any time that a user access can be obtained, the ability to provide factory sealing is impaired. It has been previously difficult to provide user access without a statistical chance of breach of sealing.

Another goal for underwater motive devices is to insure as much as practical that the user is ready to power the device. The provision of an operation switch which is difficult to operate in order to prevent inadvertent operation is generally disadvantageous. Where the user needs frequent starting and stopping, the extra time spent fumbling with an "out of the way" switch will severely reduce the utility of the device. Conversely, the prominence of the switch can contribute to inadvertent actuation.

When stored in the powered, battery connected condition, inadvertent activation can deplete the battery. During use, inadvertent activation can cause the device to go out of a user's control.

What is needed is an underwater motive device which enables easy access to battery change out without diminishing the integrity of the sealed components. Battery change out should be able to be accomplished with ease, and by persons having limited strength. The needed underwater motive device should have a switching system which is handy yet contains safeguards against inadvertent activation and loss of control. Finally, a device is needed which can include factory sealing of most components with minimum sealing breach by the user.

SUMMARY OF THE INVENTION

An underwater motive device provides an integrated and modular battery and motive housing which is carried within an outer housing and secured by a nose cone system. The nose cone system works against an "o" ring seal carried between a structure of the integrated and modular battery and motive housing and the outer housing. A pair of latches act as levers to forcibly push the nose cone in place to seal off the battery compartment. The same pair of latch levers operate a slight cam which is used to urge the nose cone to a disengaged position with respect to the "o" ring seal. The underwater motive device is configured to enable operation of the nosecone latch when the underwater motive device is in the upright position, and incudes a sturdily supported propeller cowling which permits a stable, centered, supported upright position from which the nose cone removal and re-sealing procedure can be accomplished easily, even by those of limited strength.

The actuation buttons are prominently placed and easily found by touch and feel. One of the handles also includes a rearward lockout so that the underwater motive device can be stored in bulk without the possibility of inadvertent activation if both prominent activation buttons are depressed.

The integrated core assembly of the underwater motive device is used both as a sealing boundary, maintenance aid and a mechanism to limit the need for multi-location user access. The core unit includes an integral structure having a forward battery compartment with a bayonette connector wire leading to a sealed access to the rear sealed motor volume. A shaft from the motor extends through an opening in the rear compartment which enables extension out of the rear compartment while sealing the shaft against the core unit housing. The core unit housing fits through the center of the outer housing and is secured to the outer housing by threaded members. An "o" ring seal is place in a space between the forward peripherally radially extending lip and an adjacent structure of the outer housing is engaged by a sealing surface on the inside of the front nose cone to provide sealing integrity.

Even if water inadvertently enters the battery compartment, it cannot travel farther into the sealed motor compartment. If moisture is present in small amounts, it can be easily seen and removed each time the nose cone and battery compartment are accessed to change the battery. The completely sealed compartments then include the nose cone and battery compartment. The rearward sealed motor and shaft compartment remains independently factory sealed, even against the forward located nose cone and battery compartment.

The resulting underwater motive device is simple, easy to use, and can be quickly opened, its battery disconnected and a new battery re-connected, and closed for return to use in less than 30 seconds.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
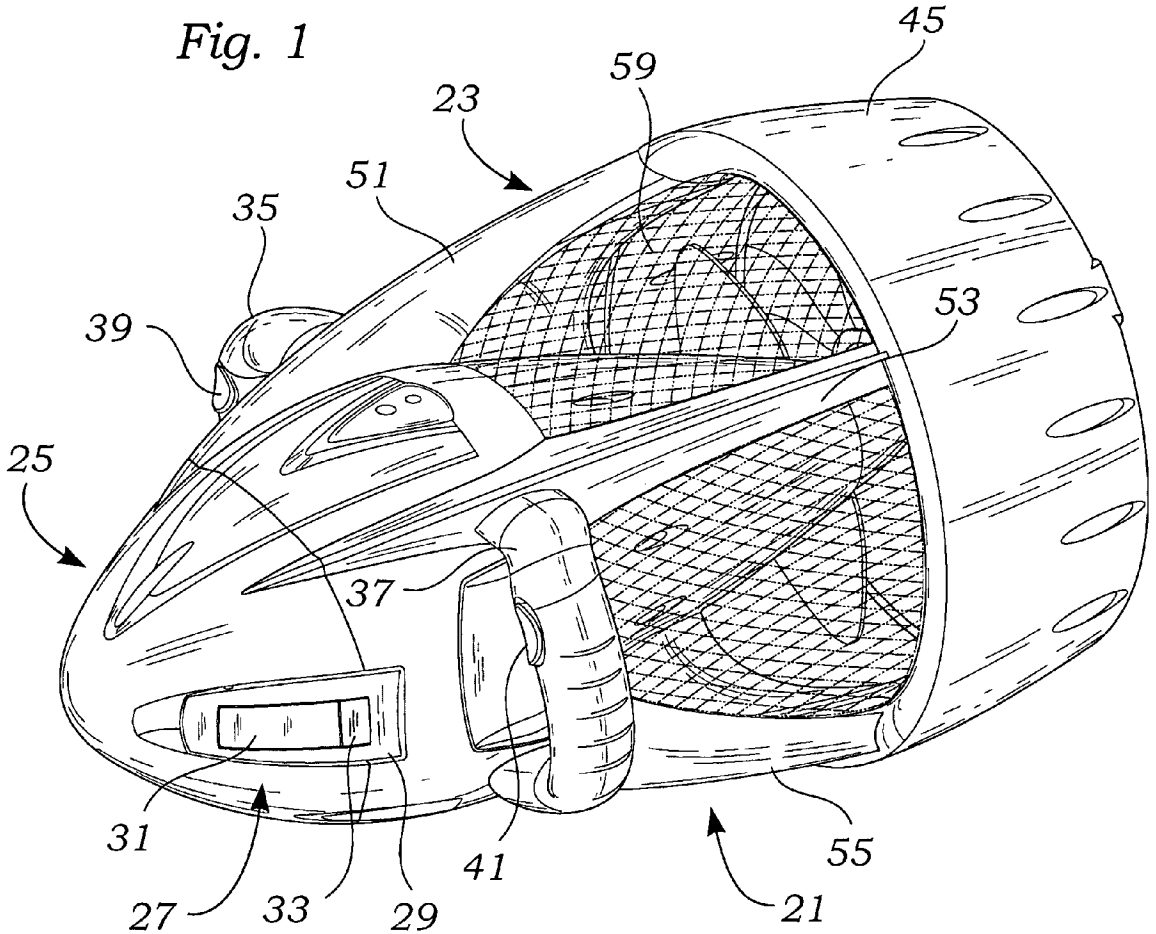
FIG. 1 is a perspective view of the underwater motive device of the present invention.

The description and operation of the invention will be best initiated with reference to FIG. 1. An underwater motive device 21 has a seemingly integrated outer rear housing 23 which has seemingly continuous external lines with a front nose cone 25. One of two identically numbered side latches is seen as a latch 27 which includes a latch frame member 29 which is pivotally mounted with respect to the forward end of the outer rear housing 23. A pivoting engagement member 31 is pivotally attached to the inside forward end of the latch frame member 29 and has a rearward end which engages a projection 33 which is preferably integral with the nose cone 25. As will be seen a rear inner portion of the latch frame member 29 includes a cam member to cause the nose cone 25 to be gently urged from its engagement to the front end of the outer rear housing 23.

Features of the outer rear housing seen in FIG. 1 also include integral side handles 35 and 37. A prominent actuation switch 39 is seen on side handle 35 while a prominent actuation switch 41 is seen on side handle 37. A rounded propeller cowling 45 is seen at the rear of the outer rear housing 23. Rounded propeller housing 45 is well supported by a set of four angular supports 51, 53, 55 and 57 (57 not being seen in FIG. 1). A series of net mesh panels 59 are supported in between pairs of adjacent angular supports 51, 53, 55 and 57. Net mesh panels 59 are preferably resilient so as to withstand small bumps and spring back into place. The cross sectional area is preferably such that no significant pressure drop will occur for water flowing through the propeller housing 45.

Figure 2:
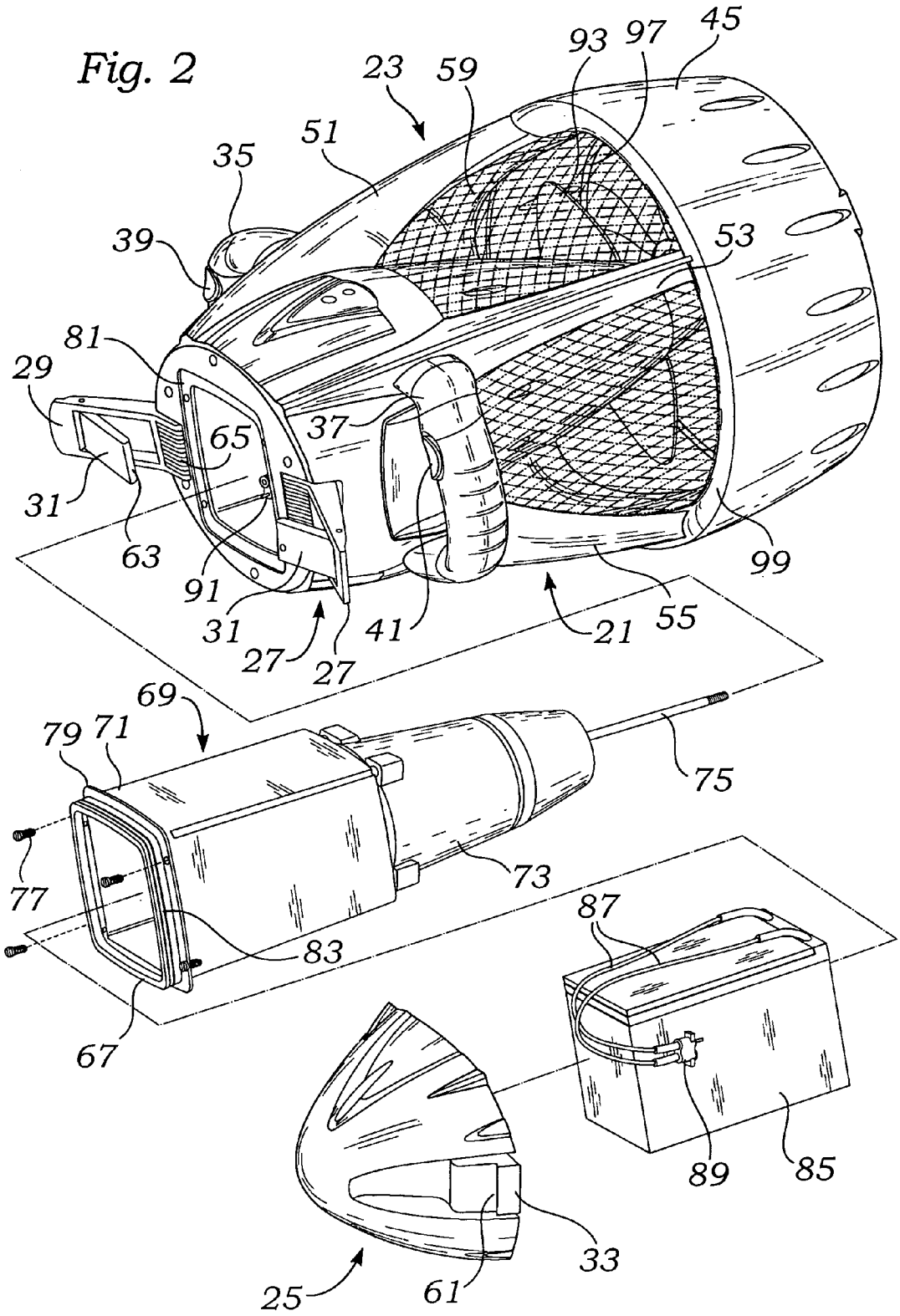
FIG. 2 is an exploded view of the underwater motive device of FIG. 1 and illustrating the inner core and its forward battery chamber and rearward motor compartment.

Referring to FIG. 2, an expanded and exploded view of the underwater motive device 21 of FIG. 1 is shown. Beginning at the front of the nose cone 25, the complete contour of the surfaces surrounding projection 33 show a smooth groove 61 slightly forward and inboard of the projection 33 into which a matching surface rear end 63 latch 27 interfits. The smooth groove 61 enables the surface rear end 63 to rotatably pivot in a low-friction controlled matter to urge the nose cone 25 rearwardly against the front of the outer rear housing 23.

Also seen in FIG. 2 are periodically occurring ribbed shaped cam surfaces 65 which will push nose cone 25 away from the front of the outer rear housing 23 when the latch frame members 29 are in a position near their fully open position. The pivoting engagement members 31 are shown in a position in which they would be enabled to fold toward the smooth grooves 61, along with the inward folding of the latch frame members 29, of the front nose cone 25. This mechanical leverage is used to securely force the front nose cone 25 into sealing position. The cam surfaces 65 are used for mechanical leverage in the disengagement of the nose cone 25.

Inboard of the smooth groove 61 slightly forward and inboard of the laches 27, a raised edge 67 is the forward most projection of the inner core 69, including a forward battery chamber 71, and a rearward motor compartment 73. Inner core 69 may be mounted in an offset, non-centered relationship with respect to the outer rear housing 23 to create a single possible interfitting relationship despite the bilaterally placed latches 27.

Extending through the rearward most end of the motor compartment 73 is a shaft 75. At the front inside of the forward battery chamber, at least two of four threaded members 77 are seen. Threaded members 77 engage a peripheral plate 79 onto a matching inset 81.

Also seen just aft of raised peripherally extending edge 67, is an "o" ring seal 83. "O" ring seal 83 is preferably a continuous length of elastomeric material which extends significantly peripherally outwardly of the outward most peripheral extent of the edge 67. The degree of compression of the "o" ring seal 83 is proportional to the amount of sealing and the sealing force involved in placing and removing the front nose cone 65.

Just in front of the opening of the forward battery chamber 71 is a battery 85 having a pair of leads 87 leading to a keyed bayonette connector 89. The bayonette connector has a male and a female portion so that the user cannot inadvertently reverse the polarity of connection, either to a charger or to a connector 91 which is stably mounted just inside the battery compartment 71 opening. Sufficient clearance remains between the battery 85 and the closest internal dimension of the inside of the forward battery chamber 71 to provide clearance for the pair of leads 87 while providing close support clearance to for an integral fit. The connector 89 can be connected and disconnected to the connector 91 while the battery 85 is in place within the forward battery chamber 71.

Also seen through a partial cut away view of the net mesh panels 59 is a propeller 93 attached to the shaft 75 (not seen in FIG. 2. Just to the rear of propeller 93 is seen a rear screen 97 which may be formed integrally with respect to the propeller cowling 45. With both the rear screen 97 and net mesh panels 59, water enters the area of the propeller 93 and is pushed rearwardly through the rear screen 97 while keeping fingers and large objects from entering the propeller 93 area. The propeller 93 can be accessed and removed from the shaft 75, and the inner core 69 preferably by removing the propeller cowling 45 and an integrally attached rear screen 97. The propeller cowling 45 may be preferably attached to an attachment ring 99 which may be integrally formed with the four angular supports 51, 53, 55 and 57.

Figure 3:
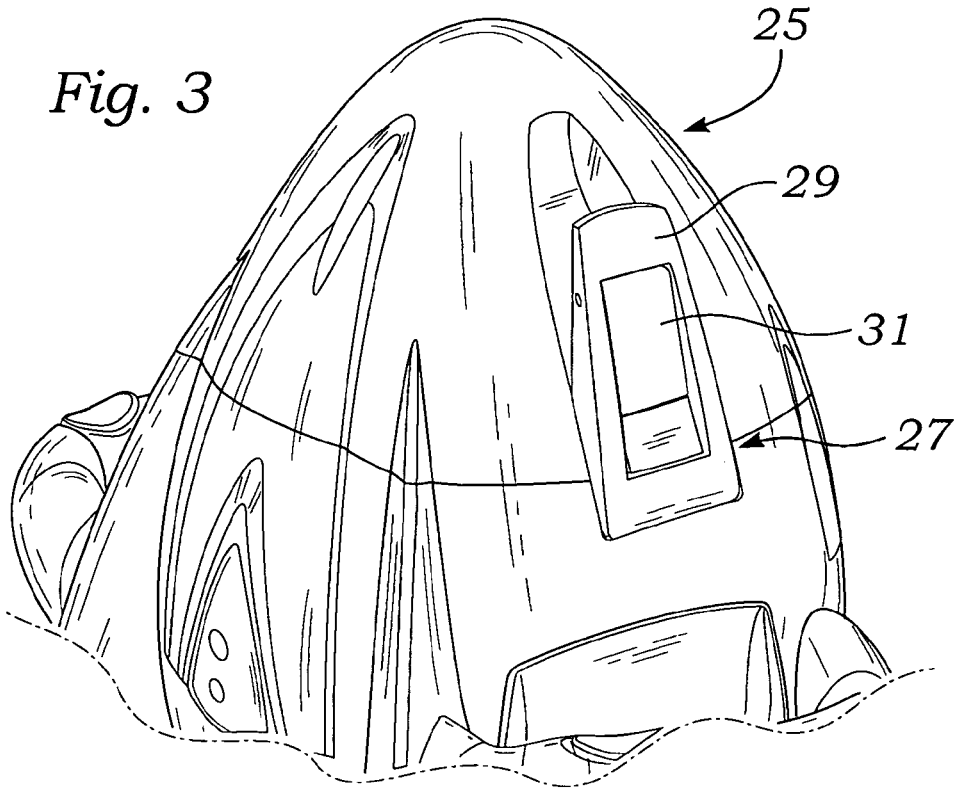
FIG. 3 is a perspective view of the front nose cone and latching assembly used to provide ease of front nose cone removal.

Referring to FIG. 3, a closeup view of the latch 27 with the latch frame member 29 shown in its midpoint position is shown. Movement of the latch frame member 29 toward the front nose cone 25 will result in force from the angles of the latch frame member 29 and pivoting engagement member 31 to further urge the latch frame member 29 toward the front nose cone 25 in a "snap" action. Movement of the latch frame member 29 away from the front nose cone 25 will result in some force movement for a short angular extent, followed by a non-force assist opening of the latch 25 to a position near the position seen in FIG. 1 in which the front cone 25 is no longer axially held in place.

Figure 4:
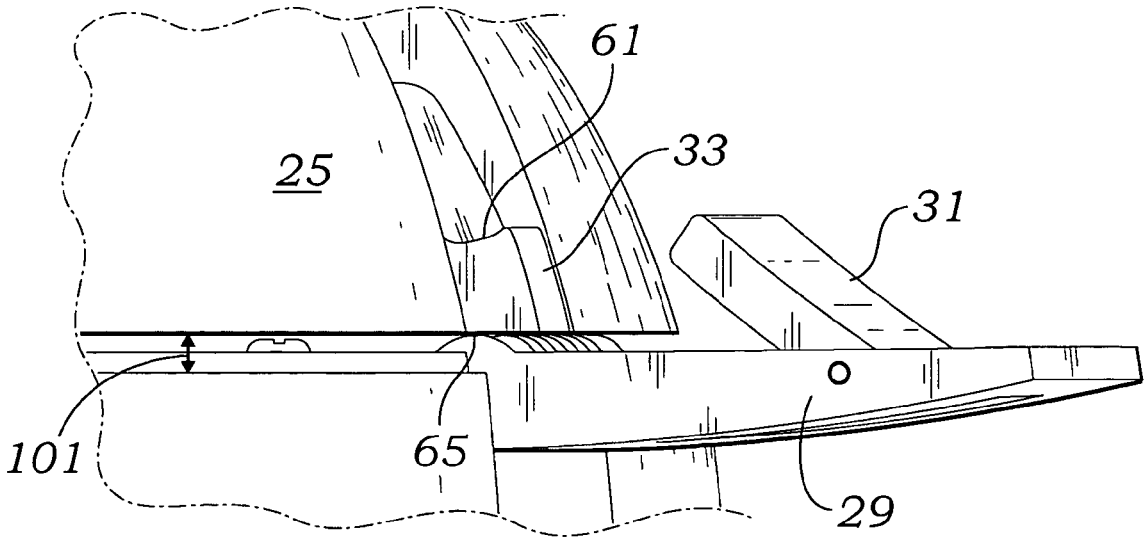
FIG. 4 is a lateral view looking into the latching assembly's cam structure used to mechanically advantageously lever the front cone away from the outer rear housing.

The action and movement of the last few degrees of the latch frame member 29 is shown in FIG. 4. As it continues to angularly open, the cam surfaces 65 begin to engage a rear surface of the front nose cone 25 to urge it about a quarter inch away from the front of the outer rear housing 23. This mechanical advantage helps the user break the seal between the outer periphery of the "o" ring seal 83 and a mating surface on the inside of the front nose cone 25. This enables a user having a weak upper body strength to remove the front nose cone 25 with no more strength than would be required to open a suitcase hasp. A gap 101 is small but sufficient so to allow the front nose cone 25 to be removed.

Figure 5:
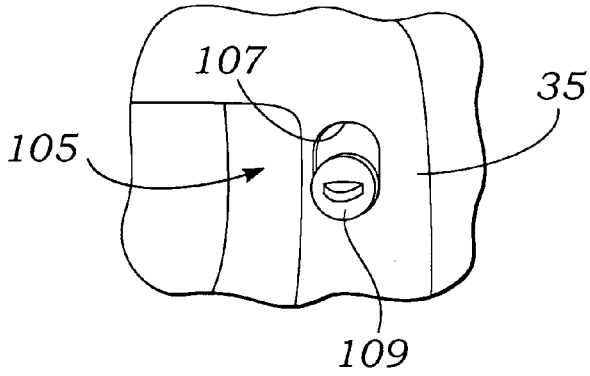
FIG. 5 is an expanded view of a thumb operated lockout mechanism mounted rearwardly on an integral side handle.

Referring to FIG. 5, a thumb lockout mechanism 105 is shown in one of the integral side handles, in this case integral side handle 35. A slot 107 enables the movement of a sliding member 109 to a lower position enabling the actuation of the prominent actuation switches, in this case prominent actuation switch 41. An upward position of the sliding member 109 blocks the engagement of the prominent actuation switch 41.

Figure 6:
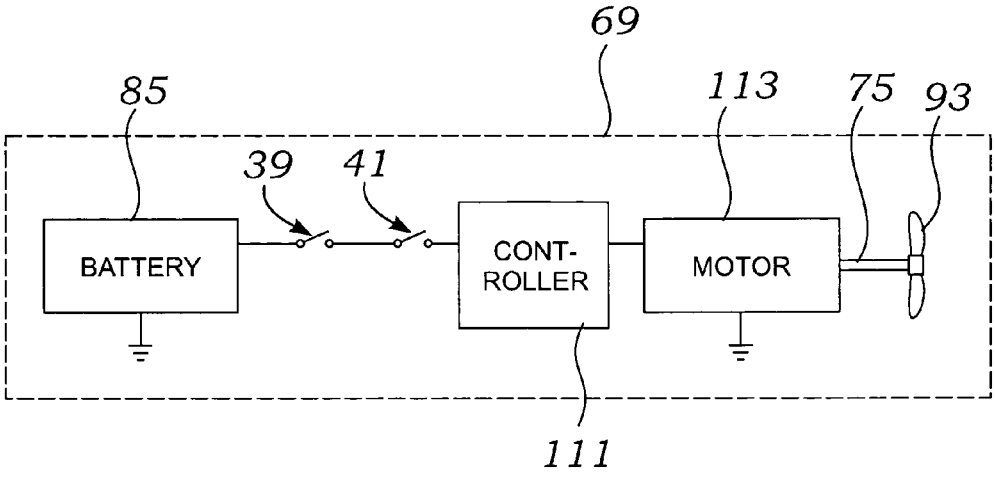
FIG. 6 is a schematic view of the circuitry and controller connection with respect to the actuation switches.

Referring to FIG. 6, an operating schematic illustrates the double actuation of the prominent actuation switches 39 and 41 necessary for operation of the underwater motive device 21 via a series connection. Battery 85 has one pole connected to a controller 111 and a second pole connected to controller 111 through a series connection of switches 39 and 41. Controller 111 is utilized to create a delay to further downstream energization in order to make certain that the activation of the propeller 93 is intended by the user. Also shown is that the components forward of the shaft 75 lie within the inner core 69.

Especially where the activation switches 39 and 41 are prominent, it is desired to have enough of a delay that the propeller 93 not start turning before the user has had a chance to adequately grip the integral side handles 35 and 37. Controller 111 is electrically connected to a motor 113 which is mechanically connected to the shaft 75 and propeller 75 previously seen in FIG. 2.

In terms of utilization, the underwater motive device 21 offers advantages previously not seen in underwater motive devices. The structures for accessing the battery make extended use of the underwater motive device 21 available to everyone, regardless of upper body strength. The unitary inner core 69 facilitates repair and replacement of the unitary inner core 69 should an internal malfunction occur.

While the present invention has been described in terms of an underwater motive device, & more particularly to a particular structure and system which utilizes a user-friendly battery access system, controller which provides power delay, and ease of servicing, this mechanism can be applied to other devices.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An underwater motive device comprising:

an outer rear housing including a pair of oppositely located integral side handles;

an inner core having a forward battery chamber connected to a rearward motor compartment;

a motor within said inner core and having a shaft extending out of said inner core, and wherein removal of said inner core enables simultaneous removal of said forward battery chamber and said rearward motor compartment and said motor;

a battery carried and substantially enclosed by said forward battery chamber of said inner core;

switch means, carried by said outer rear housing and operably connected between said battery and said motor, for actuating said motor;

a propeller carried by said shaft; and a front nose cone attached to at least one of said outer rear housing and said inner core, to seal said forward battery chamber against moisture.

2. The underwater motive device as recited in claim 1 wherein said propeller is at least partially enclosed by at least one of a cage and a screen to inhibit contact between said propeller and said user.

3. The underwater motive device as recited in claim 1 wherein said switch means is supported by one of said pair of oppositely located integral side handles.

4. The underwater motive device as recited in claim 3 and further comprising a thumb lockout mechanism.

5. The underwater motive device as recited in claim 1 and further comprising a sealing structure interposed between said front nose cone and said inner core.

6. The underwater motive device as recited in claim 5 wherein said sealing structure is an "o" ring structure surrounding at least a part of said inner core.

7. The underwater motive device as recited in claim 1 and further comprising at least one external latch pivotally supported by said rear outer housing and engaging a projection on said front nose cone, for affixing said nose cone in a closed position with respect to said rear outer housing.

8. The underwater motive device as recited in claim 7 wherein said latch is a latch frame member and further comprising a pivoting engagement member pivotable with respect to said latch frame member, and wherein said pivoting engagement member engages said projection mechanically urging said nose cone in a closed position with respect to said rear outer housing when said latch frame member is pivoted to a forward position.

9. The underwater motive device as recited in claim 7 wherein said latch further comprises:

a latch frame member having a first end pivotably connected to said rear outer housing and a second end; and a pivoting engagement member pivotably connected to said second end of said latch frame member for compressively engaging and also pivotally moving with respect to said front nose cone to apply mechanical leverage in urging said front nose cone toward said rear outer housing.

10. The underwater motive device as recited in claim 9 wherein said latch frame member includes a cam structure for urging said front nose cone away from said rear outer housing.

11. An underwater motive device comprising:

an outer rear housing including a pair of oppositely located integral side handles;

an inner core having a forward battery chamber and a rearward motor compartment;

a motor within said inner core and having a shaft extending out of said inner core;

a battery carried within said forward battery chamber of said inner core;

switch means, carried by said outer rear housing and operably connected between said battery and said motor, for actuating said motor;

a propeller carried by said shaft; and a front nose cone attached to at least one of said outer rear housing and said inner core, to seal said forward battery chamber against moisture;

at least one external latch pivotally supported by said rear outer housing and engaging a projection on said front nose cone, for affixing said nose cone in a closed position with respect to said rear outer housing and wherein said latch includes a cam structure for urging said front nose cone away from said rear outer housing.

* * * * *